US006782778B2

(12) United States Patent
Watson

(10) Patent No.: US 6,782,778 B2
(45) Date of Patent: Aug. 31, 2004

(54) SLEEVE RETENTION FOR TOOL

(75) Inventor: Nathan B. Watson, Kingston, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 14 days.

(21) Appl. No.: 10/164,142

(22) Filed: Jun. 5, 2002

(65) Prior Publication Data

US 2003/0226429 A1 Dec. 11, 2003

(51) Int. Cl.[7] ..... B25B 7/00
(52) U.S. Cl. ..... 81/427.5; 81/177.1
(58) Field of Search ..... 81/427.5, 177.1

(56) References Cited

U.S. PATENT DOCUMENTS

| | | | | |
|---|---|---|---|---|
| 409,097 A | | 8/1889 | Casey | |
| 2,871,899 A | * | 2/1959 | Coyle et al. | 81/177.1 |
| 2,985,209 A | * | 5/1961 | Novelo | 81/177.1 |
| 4,304,158 A | | 12/1981 | Brunosson et al. | |
| 5,503,049 A | | 4/1996 | Chervenak et al. | |
| 5,911,798 A | | 6/1999 | Arnold | |
| 6,089,130 A | * | 7/2000 | Wu | 81/177.1 |
| 6,131,244 A | | 10/2000 | Bares | |
| 6,134,994 A | | 10/2000 | Gomas | |
| 6,145,418 A | | 11/2000 | Bares | |
| 6,234,050 B1 | | 5/2001 | Konen et al. | |
| 6,270,134 B1 | * | 8/2001 | Lin | 81/177.1 |
| 6,473,925 B1 | * | 11/2002 | Konen | 7/107 |

* cited by examiner

*Primary Examiner*—Debra S. Meislin
(74) *Attorney, Agent, or Firm*—Cook, Alex, McFarron, Manzo, Cummings & Mehler, Ltd.

(57) ABSTRACT

A tool comprising first and second elongated members which are pivotably connected at a joint. On one side of the joint there are first and second jaw portions and on the other side of the joint there are first and second handles. There is at least one retaining element disposed near a free end of each of the first and second handles. First and second cushioned sleeves respectively receive the first and second handles. At least one engaging element is formed within each of the first and second sleeves so as to engage the retaining element and retain the sleeve on the handle. The retaining element may be in the form of a notch and the engaging element may be in the form of a projection. The notch is defined by an interior surface which is curved about a center which is located within the handle. At least one barb is disposed at the periphery of the notch.

18 Claims, 2 Drawing Sheets

SLEEVE RETENTION FOR TOOL

BACKGROUND OF THE INVENTION

The invention relates to hand tools having sleeves covering their handles. Electricians, carpenters, plumbers or other tradespeople who make repetitive use of the same hand tool are susceptible to having their hands become sore or injured through repetitive use of the tool. For this reason tools are often provided with a sleeve on the handles to provide a more comfortable gripping surface for the user and to reduce the risk of fatigue or injury.

The sleeves have been attached to the handles in a variety of ways. Sometimes adhesives are used. The adhesive is applied to the handle or it is injected into the sleeve before the handle is inserted into the sleeve. It is important not to use too much adhesive otherwise the result is messy. On the other hand, using too little adhesive will fail to adequately secure the sleeve to the handle with the result that one or more of the sleeves may slide off the handle during use. Another method of attaching a sleeve to a handle is an interference fit. The inside surface of the sleeve generally defines a cavity in the shape of the handle but slightly smaller than the handle. The sleeve is made of a resilient material so that it may stretch to the size of the handle and form a tight, high friction engagement around the handle. Since the sleeve cavity is smaller than the handle, it can be difficult to insert fully the handle into the sleeve because each portion of the sleeve must stretch to accommodate the handle as the handle is inserted all the way into the sleeve. On the other hand, if the sleeve cavity is made too large the sleeves may inadvertently slide off the handles during use. Still another technique for providing a sleeve is a hot dip coating process. The handle is dipped in a high temperature bath of liquid coating material which then cools to form a sleeve. While this process positions the sleeve snugly around the handle without stretching difficulties, the resulting material may not provide the desired cushioned feel to the user once the material cools to ambient temperature.

The present invention provides for a tool with sleeve retention which mechanically retains the sleeves on the handles while providing the desired cushioned grip.

SUMMARY OF THE INVENTION

The hand tool sleeve retention of the present invention will be described as it would be applied to tools in the nature of pliers or wire strippers. It will be understood that the invention is applicable to a wide variety of hand tools and is not limited to pliers. Pliers are generally comprised of first and second elongated members which are pivotably connected at a joint. Each of the first and second elongated members has first and second jaw portions disposed on one side of the joint and first and second handles disposed on the opposite side of the joint. The first and second handles each have first and second free ends which are located opposite the joint. There is at least one sleeve retaining element disposed near each free end. One type of retaining element comprises a notch although other retaining elements are possible. The first and second handles are inserted into first and second sleeves, respectively. Each sleeve has at least one engaging element formed therein and correspondingly positioned to engage at least one retaining element when the sleeve is placed on the handle. The engaging element may be in the form of a projection or the like.

Where the retaining element is formed as a notch, the notch may be curved about a center which is located within the handle. Barbs are formed on the handle by a convergence of a handle outer surface with the interior or arcuate surface of the notch. In this way, the barbs are disposed at the periphery of the notch and the arcuate extent or circumference of the notch is greater than 180° but less than 360°, with the center of the notch located within the handle.

DETAILED DESCRIPTION OF THE INVENTION

Figure 1:
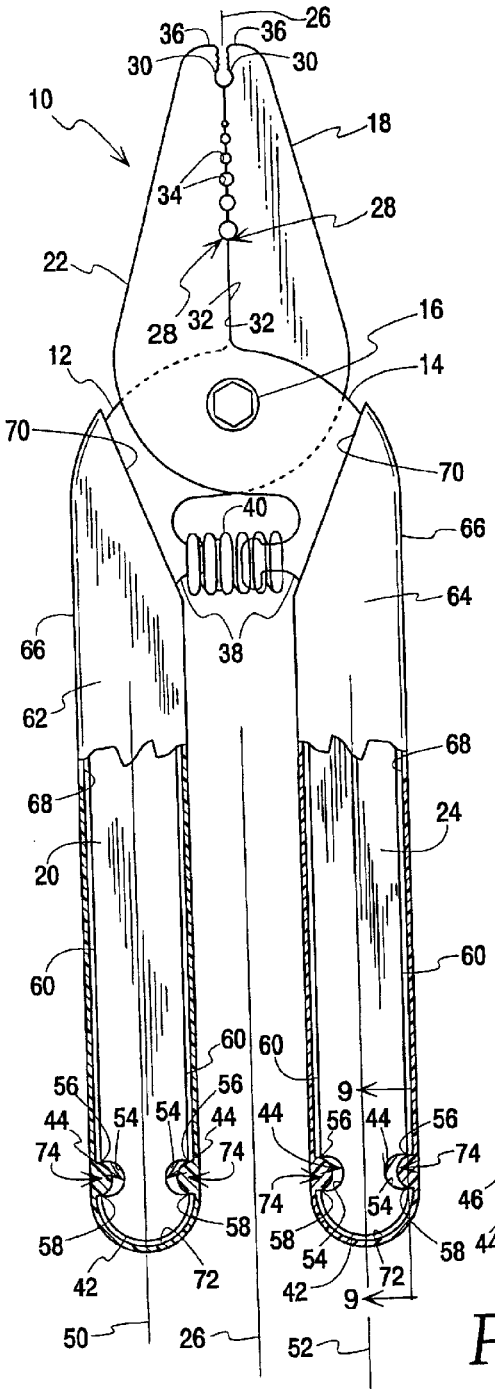
FIG. 1 shows a plan view of the present invention as applied to a wire stripper, with portions of the sleeves shown in section.
Figure 6:
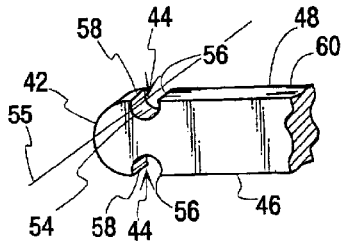
FIG. 6 shows a perspective view of a handle free end.

FIG. 1 shows a tool 10 of the present invention. Although the tool shown is a wire stripper, the invention is not intended to be limited to a wire stripper and is, in fact, applicable to any type of tool. The tool 10 includes a first elongated member 12 and a second elongated member 14 joined by a pivotal connection or joint 16. The first elongated member 12 has a jaw portion 18 positioned on one side of the joint 16 and a handle 20 positioned on the opposite side of the joint. Likewise, the second elongated member 14 has a jaw portion 22 located on the same side of the joint as the first jaw portion 18 and a handle 24 positioned on the opposite side of the joint.

The first and second jaw portions 18 and 22 are juxtaposed so as to define a longitudinal axis 26 along the length of the tool 10. Each jaw portion 18 and 22 generally has a blade section 28 and a gripping section 30. The blade section 28 may be comprised of a straight cutting edge 32 and a notched cutting edge 34. The notched cutting edges of the first and second jaw portions are aligned with each other so as to define a plurality of wire stripping holes of various sizes. The notched cutting edges allow for piercing of the insulation which surrounds the conductor wire so as to strip the insulation from the wire without cutting the conductive wire underlying the insulation. The gripping section 30 is located near a nose 36 of the tool 10. The gripping section 30 has a jagged surface to provide increased friction when the gripping section 30 is used to clamp or crimp objects between the nose 36. The first and second jaw portions 18 and 22 are pivotally connected at the joint 16. The connection at the joint is secured by a bolt or other like member.

Near the joint, each of the first and second handles 20 and 24 have an extension 38 which extends transversely in relation to the longitudinal axis 26. Each extension portion 38 extends inwardly toward the other to generally meet each other at the axis 26 when the tool is closed. A spring 40 is positioned over each extension portion 38 to normally bias the handles away from each other.

Figure 9:
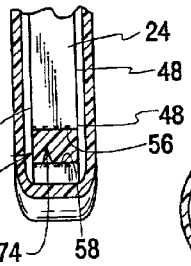
FIG. 9 is a section taken along line 9—9 of FIG. 1.
Figure 2:
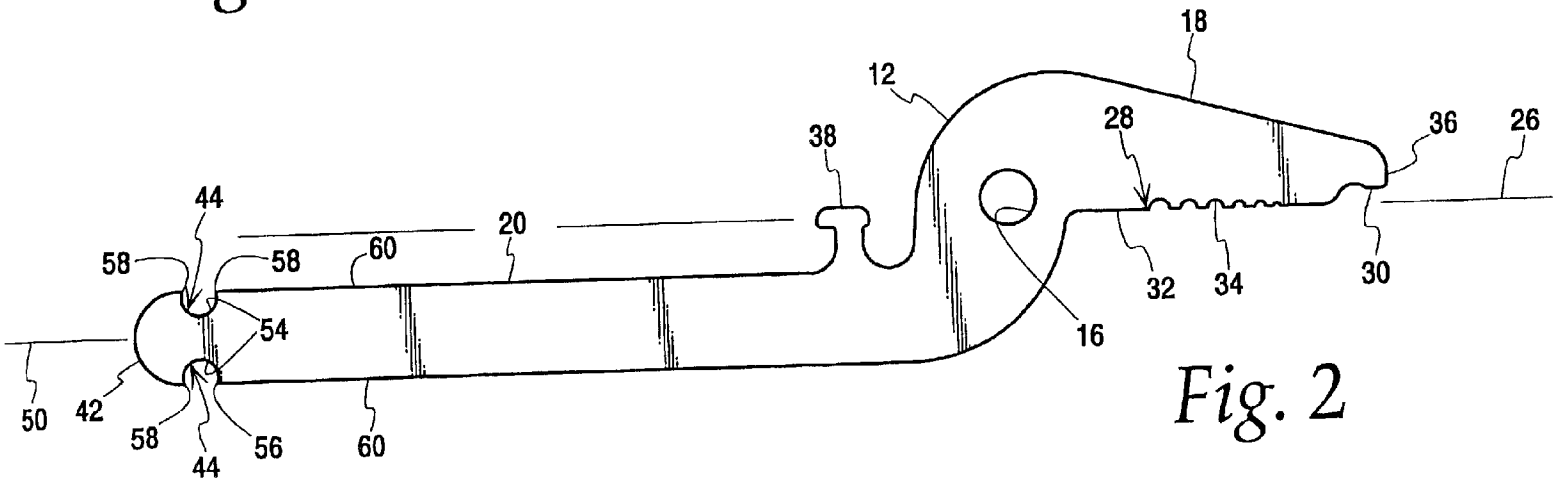
FIG. 2 shows a plan view of one of the elongated members.

Each of the first and second handles 20 and 24 has a free end 42. Near the free end 42 there is a retaining element, generally indicated at 44. At least one retaining element 44 is disposed on each of the first and second handles 20 and 24. The retaining element 44 is shown as a notch although other like members may be used such as a recess, groove, sink, slot or other receptacle. In FIGS. 1 and 2, two notches are positioned proximately to each free end 24 of the first and second handles 20 and 24. As shown in FIG. 9, each handle 20 and 24, has a front side 46 and a rear side 48. The notch 44 is transversely positioned along each of the handles and extends from the front side 46 to the rear side 48 of each handle 20 and 24, respectively. Each of the first and second handles 20 and 24 may define a first and second handle axis 50 and 52, respectively, on either side of which the retaining elements may be located. For example, the first handle 20 in FIG. 1 shows one retaining element 44 is located on one side of the first handle axis 50 and another second retaining element 44 is located on the other side of the first handle axis. Likewise, the second handle 24 shows one retaining element 44 located on one side of the second handle axis 52 and another second retaining element 44 located on the other side of the second handle axis.

The notch 44 defines an interior surface 54 which is curved as shown in FIGS. 1–3 and 5–6. The interior surface 54 is curved about a lateral axis, indicated at 55 in FIG. 3, which is located within the first and second handles 20 and 24. The measurement of the arcuate length, indicated at A, of the notch interior surface 54 about the axis 55 is approximately defined by the range between 180° and 360°. Barbs are positioned along the periphery of the notch. As shown in FIGS. 3, 5–6 and 9, there is an upper barb 56 positioned along one side of the notch and a lower barb 58 positioned along the opposite side of the notch. Each barb is formed by the confluence between a handle outer surface 60 and the interior surface 54 of the notch. The barb may be continuously formed along each side of the notch or intermittently positioned along each notch side. As shown in FIGS. 3, 5–6 and 9, the notch interior surface 54 and the handle outer surface 60 converge to a single edge to form each barb. Due to the arcuate extent A of the notch 44 being approximately between 180° and 360°, the opening between the barbs 56 and 58 is narrower than the widest portion of the notch.

Figure 4:
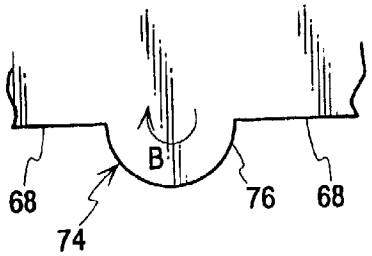
FIG. 4 shows an enlarged view of the engaging element on the sleeve.
Figure 3:
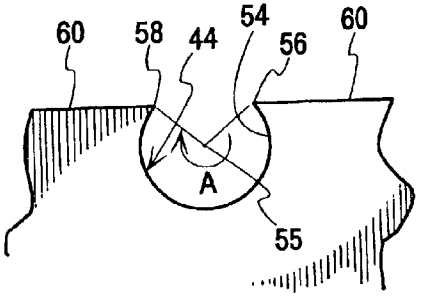
FIG. 3 shows an enlarged view of the retaining element on the elongated member.

Each of the first and second handles 20 and 24 are covered by first and second sleeves 62 and 64, respectively. The sleeves are made of a soft, cushioned, elastic material. Each first and second sleeve 62 and 64 has an outer surface 66 and an inner surface 68. The inner surface 68 of the sleeve is formed so that when the handle is fully inserted into the sleeve, the inner surface of the sleeve generally matches the handle outer surface 60. Each sleeve has an open end 70 into which the free end 42 of the handle is first inserted and a closed end 72. An engaging element 74 is disposed on the inner surface 68 of the sleeve near the closed end 72. Each sleeve 62 and 64 may be slidably moved onto the corresponding handle 20 and 24 until the handle free end 42 is juxtaposed to the sleeve closed end 72. When the sleeve is fully inserted onto the handle, the engaging element 74 is aligned with the retaining element 44. The engaging element 74 contacts the retaining element 44 so as to retain the sleeve on the handle. The engaging element 74 may be in the form of a projection having a curved surface. As shown in FIG. 4, the engaging element may have an exterior surface 76 which has a semi-circular or spherical shape. The arcuate extent B of the engaging element 74 is approximately 180° although other arcuate measurement are possible.

Engagement between the sleeve and the handle for mechanical retention occurs when the engaging element 74 is received by the retaining element 44. The engaging element 74 is sandwiched between the upper and lower barbs 56 and 58. It is generally preferred that the engaging element define a width which is be approximately equal to or larger than the opening defined between the upper and lower barbs 56 and 58. Where the engaging element 74 is larger than the retaining element 44, it is realized that the engaging element may be elastically deformed so as to be received by the retaining element 44.

Figure 5:
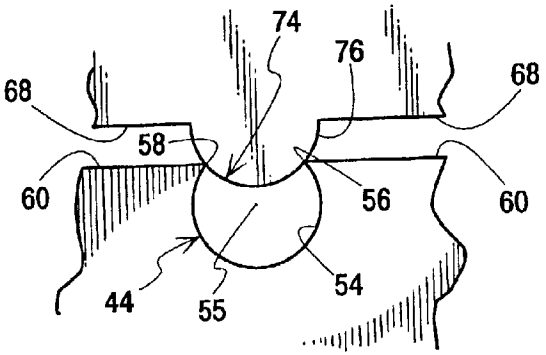
FIG. 5 shows an enlarged view of both the retaining element and the engaging element.

FIG. 5 shows the detailed engagement between the engaging element of the sleeve and the retaining element of the handle. This mechanical engagement allows for the sleeve to be permanently retained on the handle and provide a cushioned grip to the user. During assembly of the tool 10, the first and second sleeves 62 and 64 are respectively placed over the first and second handles 22 and 24. Each of the free ends 42 are inserted into the open ends 70. As each of the handles are telescoped into their respective sleeves, each of the engaging elements 74 are received by their respective retaining elements 44. The engaging element or projection is at least part way inserted into the retaining element 44 or notch. The exterior surface 76 of the projection is anchored on one side by the upper barb 56 and on the other side by the lower barb 58 so as to prevent removal of the sleeve from the handle.

The sleeves provide a soft and cushioned grip to the user. They are preferably made from any insulative material which has an inherent sponginess while also providing a sturdy handle. The material have suitable elastic properties so that the material deforms to the user's touch and provides a desirable touch and feel to the user during use of the tool 10. In addition to providing a soft cushioned grip, the sleeve also provides insulation between the handle and the user. The underlying handle material is made from metal or the like. The open ends 70 of the sleeves may have a horizontal edge or it may have a beveled edge such as that shown in FIG. 1. The beveled edge allows for a cushioned grip to the right and left of the joint 16.

Figure 7:
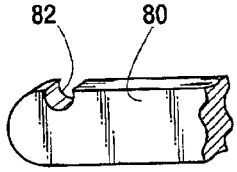
FIG. 7 shows a perspective view of an alternate handle free end.
Figure 8:
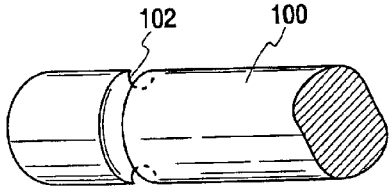
FIG. 8 shows another alternate handle free end.

Although the preferred orientation of retaining elements is shown as a pair of notches which receive a pair of projections, other shapes, number and orientations are also possible. The retaining element may have any shape such as rectangular, triangular, ellipsoid, trapezoidal or the like. As shown in FIG. 7, any number of retaining elements may be used. FIG. 7 shows a handle 80 having a single retaining element 82 in the form of a notch which receives a projection on a corresponding sleeve. The handle 100 of FIG. 8 shows a retaining element 102 which is circumferentially positioned around the handle. Likewise, the sleeve may have an annular ring or, alternatively, it may have a plurality of projections disposed on its inner surface in alignment with the retaining element so as to secure the sleeve permanently to the handle.

Figure 10:
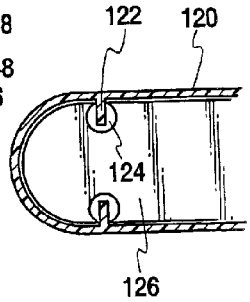
FIG. 10 shows a partial sectional view of an alternate sleeve.

The sleeve may also have different shapes and orientations such as the sleeve 120 shown in FIG. 10 which has an engaging element 122 in the form of a flange which is received within a retaining element 124 of a handle 126. Placing the sleeve with the engaging element over the handle with the retaining element allows for a permanent mechanical retention of the sleeve.

While the preferred form of the invention has been shown and described, it should be realized that there may be many alterations, modifications and substitutions thereto without departing from the scope of the claims. For example, although the retaining element of the handle is shown as receiving the engaging element of the sleeve, a reverse construction is also possible whereby the retaining element of the handle is received by the engaging element of the sleeve so as to permanently retain the sleeve on the handle. There may be any number of retaining element-engaging element pairs disposed on each handle. The retaining element may be disposed in any orientation on the handle outer surface with the engaging element correspondingly positioned in alignment so as to engage the retaining element when the handle is fully inserted into the sleeve. While it is preferred that the retaining element is positioned near or proximate to the free end of each handle, other positions of the retaining element along the handle are also possible.

What is claimed is:

1. A tool comprising:

first and second elongated members pivotably connected at a joint, each first and second elongated member respectively having first and second jaw portions disposed on one side of the joint and first and second handles disposed on the opposite side of the joint, wherein the jaw portions define a longitudinal axis, the first and second handles respectively having first and second free ends opposite the joint;

at least one retaining element disposed near each free end, wherein the retaining element is a notch which is curved about a lateral axis which is located within the handle;

first and second cushioned sleeves disposed on the first and second handles respectively, each cushioned sleeve providing a soft cushioned grip to a user; and at least one engaging element formed within each cushioned sleeve being correspondingly positioned to engage the at least one retaining element so as to mechanically retain the cushioned sleeve on the handle.

2. The tool of claim 1 wherein two retaining elements are formed on each handle.

3. The tool of claim 1 wherein at least one retaining element is proximately disposed at each free end.

4. The tool of claim 1 wherein each handle includes a handle axis, each handle including two retaining elements, one retaining element being located on one side of the handle axis and another retaining element being located on the other side of the handle axis.

5. The tool of claim 1 wherein the retaining element is circumferentially located on each handle.

6. The tool of claim 1 further including at least one barb positioned on a handle outer surface adjacent the retaining element.

7. The tool of claim 1 wherein the jaw portions define a longitudinal axis, the retaining element being transversely located in relation to the longitudinal axis.

8. The tool of claim 1 wherein the engaging element is a projection.

9. A tool comprising:

first and second elongated members pivotably connected at a joint, each first and second elongated member respectively having first and second jaw portions disposed on one side of the joint and first and second handles disposed on the opposite side of the joint, wherein the jaw portions define a longitudinal axis;

at least one notch formed in each first and second handle, the notch being curved about a center which is located within the handle; and first and second sleeves disposed on the first and second handles, respectively, each first and second sleeve including at least one projection therein for engaging the at least one notch on the corresponding handle so as to retain the sleeve on the handle, the notch being curved about a lateral axis which is transversely located in relation to the longitudinal axis.

10. The tool of claim 9 wherein two notches are formed on each handle.

11. The tool of claim 9 wherein the notch is circumferentially located on each handle.

12. The tool of claim 9 further including at least one barb is disposed at the periphery of the notch.

13. The tool of claim 9 wherein a diameter of the notch is within the range of 0.01 to 1 inches.

14. The tool of claim 9 wherein a diameter of the notch is about 0.17 inches.

15. A tool comprising:

first and second elongated members pivotably connected at a joint, each first and second elongated member respectively having first and second jaw portions disposed on one side of the joint and first and second handles disposed on the opposite side of the joint, wherein the jaw portions define a longitudinal axis;

at least one notch formed in each first and second handle, the notch being curved about a lateral axis which is located within the handle;

at least one barb disposed at the periphery of the notch; and first and second sleeves disposed on the first and second handles, respectively, each first and second sleeve including at least one projection therein for engaging the at least one notch on the corresponding handle so as to mechanically retain the sleeve on the handle.

16. The tool of claim 15 wherein the barb is formed by a convergence of a handle outer surface with a notch interior surface.

17. A tool comprising:

a handle having at least one retaining element disposed thereon and defining a handle axis;

a cushioned sleeve disposed on the handle; and at least one engaging element formed within the cushioned sleeve being correspondingly positioned to engage the retaining element so as to retain the cushioned sleeve on the handle wherein the retaining element is a notch which is curved about a lateral axis which is transversely located in relation to the handle axis.

18. The tool of claim 17 wherein the notch defines an arcuate curve which extends approximately between 180 degrees and 360 degrees.

* * * * *